US006179588B1

(12) United States Patent
Liang et al.

(10) Patent No.: US 6,179,588 B1
(45) Date of Patent: Jan. 30, 2001

(54) CHECK VALVE DEVICE FOR A SCROLL MACHINE

(75) Inventors: Kun-I Liang; Ching-Feng Lai; Tse-Liang Hsiao; Ann Huang; Yu-Choung Chang; Chun-Chung Yang; Ching-Eeng Tsai, all of Hsinchu (TW)

(73) Assignee: Industrial Technology Research Institute, Hsinchu (TW)

( * ) Notice: Under 35 U.S.C. 154(b), the term of this patent shall be extended for 0 days.

(21) Appl. No.: 09/164,899

(22) Filed: Oct. 1, 1998

(51) Int. Cl.[7] ..... F04C 18/00

(52) U.S. Cl. ..... 418/55.1; 418/270; 137/527.8; 137/527

(58) Field of Search ..... 418/55.1, 270; 187/527.8, 527

(56) References Cited

U.S. PATENT DOCUMENTS 3,331,391 * 7/1967 Merdinyan ..... 137/527
4,967,790 * 11/1990 Ganske ..... 137/527.8 X
5,522,423 * 6/1996 Elliot ..... 237/527.8 X
5,735,678 * 4/1998 Fukuhara et al. ..... 418/270

FOREIGN PATENT DOCUMENTS

0242483 * 11/1991 (JP) ..... 418/55.1
405272472 * 11/1991 (JP) ..... 418/55.1

* cited by examiner

*Primary Examiner*—Thomas Denion
*Assistant Examiner*—Thai-Ba Trieu
(74) *Attorney, Agent, or Firm*—W. Wayne Liauh

(57) ABSTRACT

A check valve device for a scroll machine is used to automatically maintain a unique flow direction of the working media. The check device is mounted on the neck of the non-orbiting scroll member of the scroll machine, in which the neck has an axle hole for defining a first passage for flowing the working media. The check valve includes a housing and a valve member. The housing has a through second passage, and couple with the neck in such a manner that a through passage is formed for connecting the first passage of the neck and the second passage of the housing. The valve member is located inside the second passage of the housing, and is formed as a plate with a pivot means to rotate along. While the scroll machine is in stop operation, the valve member is at a close position that the valve member can substantially block the flow of the working media inside the second passage. While the scroll machine is in compression operation, the valve member is at an oblique open position for allowing the working media flowing through the through passage.

16 Claims, 4 Drawing Sheets

CHECK VALVE DEVICE FOR A SCROLL MACHINE

BACKGROUND OF THE INVENTION (1) Field of the Invention

The invention relates to a check valve device for a scroll machine, and more particularly to a safety apparatus which utilizes the in-flow pressure difference to control the operation of a valve member for preventing the scroll members of the scroll machine from impact damage caused by a possible transient reverse flow.

(2) Description of the Prior Art

A conventional scroll machine or a volute compressor in the art can be structured as shown in FIG. 1. The conventional scroll machine comprises mainly a shell 10, a separating member 14 inside the shell 10, a non-orbiting scroll member 24 installed below the separating member 14, an orbiting scroll member 30 to mesh with the non-orbiting scroll member 24, a frame 12 to rest the orbiting scroll member 30 and other necessary components. When the non-orbiting scroll member 24 meshes with the orbiting scroll member 30, a plurality of closed compression chambers 34 are separately formed for accommodating working media (either gas or fluid) between the non-orbiting scroll member 24 and the orbiting scroll member 30. In operation, a motor 3 located under the orbiting scroll member 30 is used to drive the orbiting scroll member 30 following an eccentric motion via a connecting rotary shaft 36, and those compression chambers 34, at the same time, move with the moving contact lines formed between the non-orbiting scroll member 24 and the engaged orbiting scroll member 30 in such a manner that the occupied volume of individual compression chamber 34 become less and less as it moves toward the center of the scroll member 24 or 30. Thereby, a compressing effect upon the working media confined in each compression chamber 34 can be formulated.

Inside the shell 10, the separating member 14 is used to define a high-pressure room 18 thereabove and a low-pressure room 20 therebelow. The only through conjunction between the high pressure room 18 and the low-pressure room 20 is structured by a neck 26 extruding from the center of the non-orbiting scroll member 24 into the high-pressure room 18. The neck 26 has an axle hole 22 and an offset hole 13 to form a through passage connecting the high-pressure room 18 and the compression chamber 34 of the low-pressure room 20, respectively. The forced flow, driven by the motor 3, from the low-pressure room 20 to the high-pressure room 18 is thus passed through the volume-reduced compression chambers 34, the offset hole 13, and the axle hole 22, and finally emitted to the high-pressure room 18.

In the case that the scroll machine faces a stop operation, the flow of the working media will be naturally reversed its direction due to the pressure difference formed between the high-pressure room 18 and the low-pressure room 20. The reverse flow will impact the compression chambers 34 through the axle hole 22 and the offset hole 13 so that the rotation of the orbiting scroll member 30 will be reverse. During the reversing, collision between the non-orbiting scroll member 24 and the orbiting scroll member 30 will be inevitable and generate a large-scale impact and noise. Such an impact and noise will eventually reduce the life time of the scroll members 24 and 30, as well as the life time of other relative components.

As exemplified by the disclosures in the U.S. Pat. Nos. 5,186,613, 4,759,696, 5,088,905, 4,904,165, and 5,451,148, various means are provided to reduce the collision between scroll members by blocking the working media flow between the high-pressure room 18 and the low-pressure room 20. However, all the means utilized by aforesaid disclosures require the modification of the original tooling to manufacture the scroll machine, which will increase the product cost substantially. It is also obvious that all the means of the aforesaid disclosures can not be applied directly to the scroll machine manufactured by the original tooling.

In addition, it is taught in the U.S. Pat. Nos. 4,759,696 and 4,904,165 that spring energy has been utilized to provide the retrieving force for blocking the flow. However, a long-term non-stop operation of the scroll machine will expedite the fatigue or degrading of the spring and thus cause problems in maintenance eventually.

SUMMARY OF THE INVENTION

Accordingly, it is a primary object of the present invention to provide a check valve device for a scroll machine, which will inhibit the reverse flow of the working media for reducing the possible element damage in a machine stop operation.

It is another object of the present invention to provide a compact check valve device for a scroll machine, which is simply structured to utilize the pressure difference for automatically controlling the operation of the check valve.

It is a further object of the present invention to provide a check valve device for a scroll machine, which will reduces the cost on manufacturing a scroll machine by providing the check valve as an upgrading kit for avoiding the cost in re-tooling the scroll machine.

The check valve device for a scroll machine in accordance with the present invention is used to automatically maintain a unique flow direction of the working media. The check device is mounted on the neck of the non-orbiting scroll member of the scroll machine, in which the neck has an axle hole for defining a first passage for flowing the working media. The check valve includes a housing and a valve member. The housing has a through second passage, and couple with the neck in such a manner that a through passage is formed for connecting the first passage of the neck and the second passage of the housing. The valve member is located inside the second passage of the housing, and is formed as a plate with a pivot means to rotate along. While the scroll machine is in stop operation, the valve member is at a close position that the valve member can substantially block the flow of the working media inside the second passage. While the scroll machine is in compression operation, the valve member is at an oblique open position for allowing the working media flowing through the through passage.

According to the present invention, the coupling of the housing and the neck can be a is a built-in type, a plug-in type, an envelope type, or any type that can form the through passage for the housing and the neck.

In one embodiment of the present invention, the pivot means is a pivot shaft mounted on the top side of the plate, and the pivot shaft has two ends thereof protruding over edge of the plate to pivotally engage with the wall of the second passage. Preferably, the pivot shaft is a symmetric curve member with a winding central portion for distributing weight of the pivot shaft upon the top side of the valve member.

According to the present invention, the maximum inclination angle for the valve member to open is no more than 90 degree , in order not to render an over-turn situation.

In one embodiment of the present invention, the valve member can further include a shoulder structure located on the top side of the plate and located oppositely to the pivot means with respect to the center line of the plate. The shoulder structure further includes top extension. While the scroll machine is in stop operation or in compression operations, the top extension can rest upon the top rim of the housing as a stop element for maintaining the valve member at the close and the oblique open positions inside the second passage, respectively. On the other hand, while the valve member is located at any position between the close and the oblique open positions, the shoulder structure is free to rotate inside the second passage.

In one embodiment of the present invention, the shoulder structure can include a pair of side wings located oppositely on valve member. Each side wing has a substantial width and a top out-bent portion to interfere with the top rim of the housing in the case that the valve member reaches the close or the oblique open position.

In one embodiment of the present invention, the housing can further include a first node point and a second node point, both of them located at the wall of the second passage. In the case that the scroll machine is in stop operation or in compression operation, the valve member is halted at the close or the oblique open positions by the first and the second node points, respectively.

In another embodiment of the present invention, the check device can also be utilized in pressure piping for regulating the in-pipe flow at a unique direction. In this embodiment, the check valve is installed in a pressure pipe, or at the terminal of a pressure pipe.

All these objects are achieved by the check valve device for a scroll machine described below.

BRIEF DESCRIPTION OF THE DRAWINGS

The present invention will now be specified with reference to its preferred embodiments illustrated in the drawings, in which.

DESCRIPTION OF THE PREFERRED EMBODIMENT

The invention disclosed herein is directed to a check valve device for a scroll machine. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
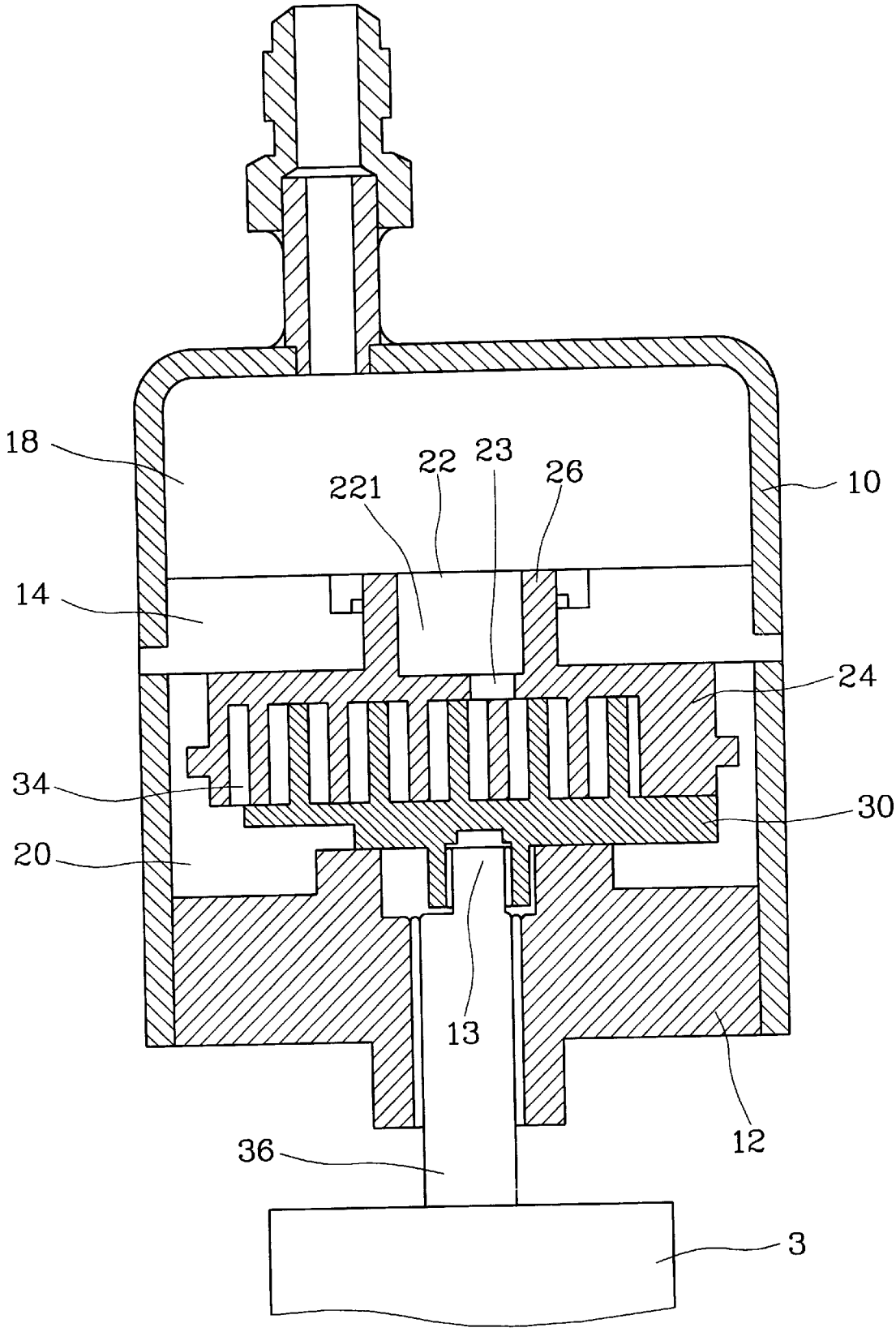
FIG.1 (PRIOR ART)
FIG. 1 is a schematic sectional view of a conventional scroll machine.

The check valve device for a scroll machine in accordance with the present invention is used to automatically maintain a unique flow direction of the working media. The check device is mounted on the neck 26 of the non-orbiting scroll member 24 (see FIG. 1) of the scroll machine, in which the neck 26 has an axle hole 22 for defining a first passage 221 for flowing the working media thereinside. The check valve includes a housing and a valve member.

Figure 3A:
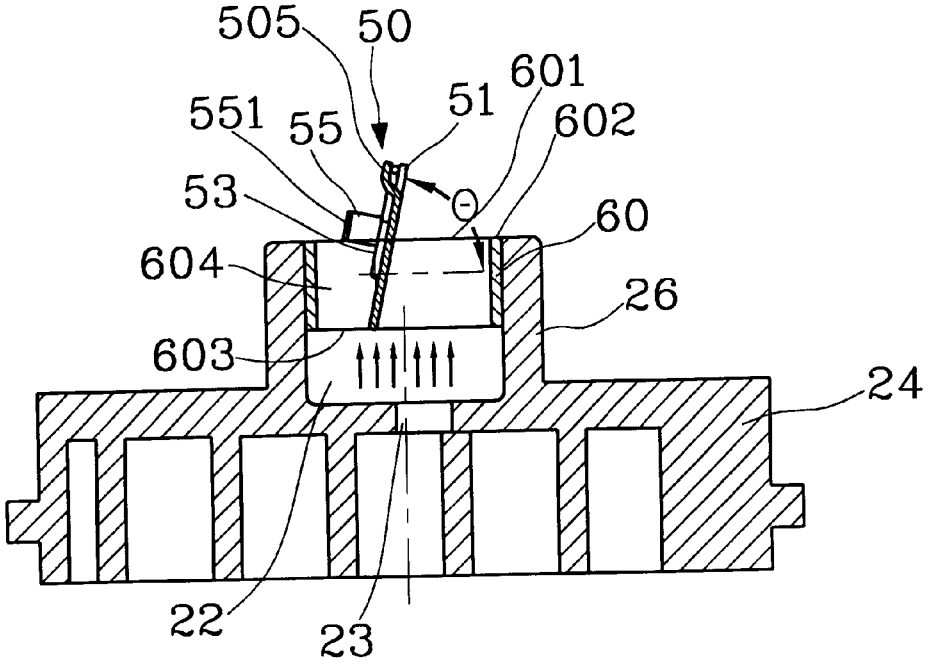
FIG. 3A is a cross sectional view of the first embodiment of the check valve device of FIG. 2 in a scroll machine showing an oblique open position.

As shown in FIG. 3A, the housing 60 has a top open end 601 with a top rim 602, a bottom end 603, and a through second passage 604 between the top open end 601 and the bottom open end 603. The housing 60 couples with the neck 26 in such a manner that a through passage is formed for connecting the first passage 221 of the neck and the second passage 604 of the housing 60.

Figure 2:
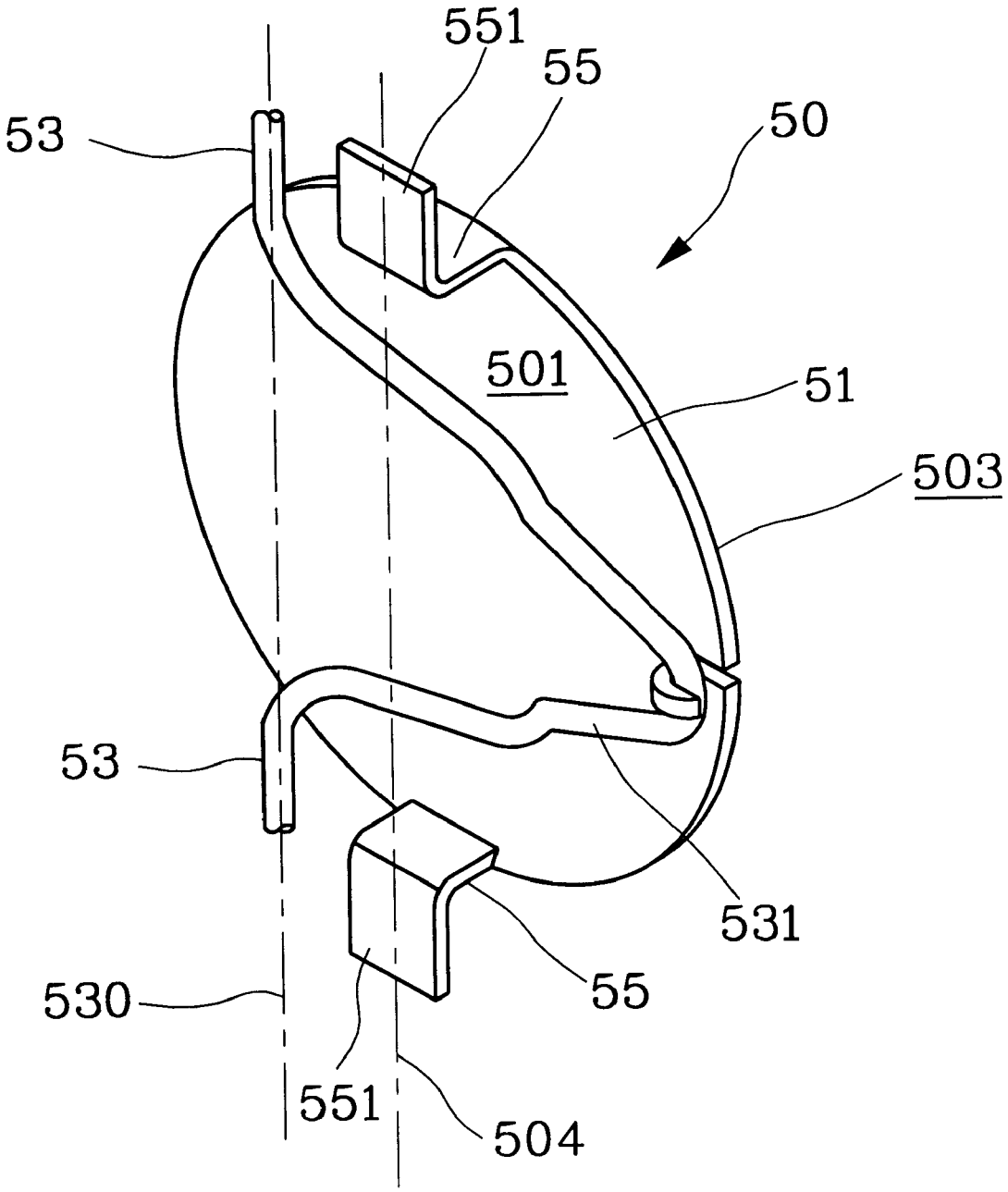
FIG. 2 is a perspective view of a check valve for a scroll machine in accordance with the present invention.

Referring now to FIG. 2 and FIG. 3A, the valve member 50 is located inside the second passage 604 of the housing 60, and is formed as a plate 51 with a pivot means to rotate along. The plate 51 has a top side 501 and a bottom side 503. While the scroll machine is in stop operation, i.e. at the stage that the scroll machine stops the forced flow of the working media from the low-pressure room to the high-pressure room; the valve member 50 is at a close position that the valve member 50 can substantially block the flow of the working media inside the second passage 604. While the scroll machine is in compression operation, i.e. at the stage that the scroll machine keeps driving the flow from the low-pressure room to the high-pressure room; the valve member 50 is at an oblique open position for allowing the working media flowing through the through passage into the high-pressure room.

In the embodiment shown in FIG. 2, the pivot means can be a pivot shaft 53 mounted on the top side 501 of the plate 51, and the pivot shaft 53 has two ends to protrude over edge of the plate 51 for pivotally engaging with the wall of the second passage 604 as illustrated in FIG. 3A. The pivot shaft 53 is offset mounted on the plate 51 with respect to the center line 505 of the plate 51; so that the plate surface of the plate 51 is divided unequally by the pivot axle 530, and by which, under a distributed pressure over the plate 51, an unbalance moment will be generated to rotate the valve member 50 about the pivot axle 530. Preferably, as shown in FIG. 2, the pivot shaft 53 is a symmetric curve member with a winding central portion 531 extending across the center line 504 of the plate 51 for distributing weight of the pivot shaft 53 upon the top side 501 of the plate 51.

Figure 3B:
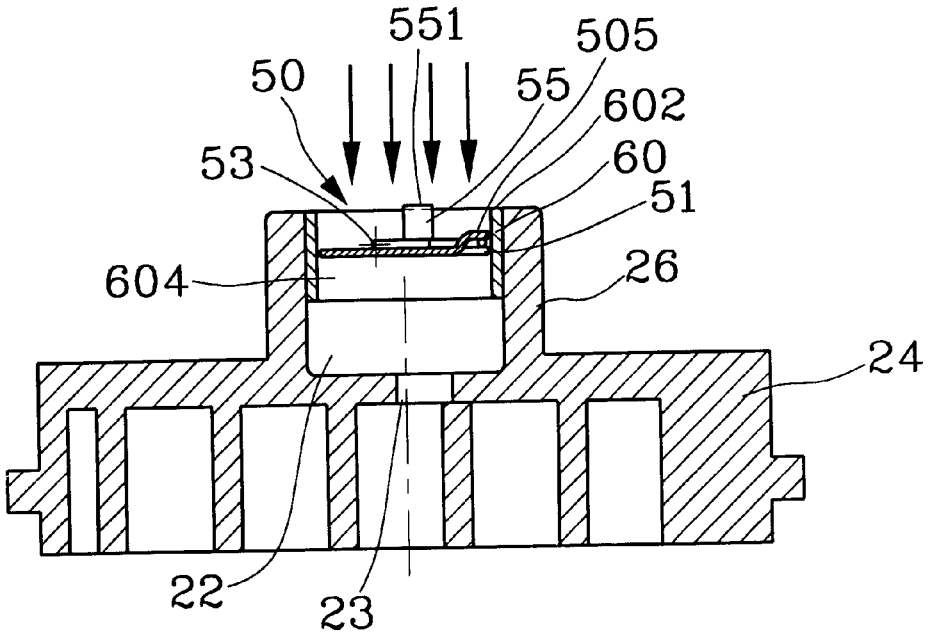
FIG. 3B is a cross sectional view of the first embodiment of the check valve device of FIG. 2 in the scroll machine showing a close position.

Referring now to FIG. 3A and FIG. 3B, the first embodiment of the check valve device is shown at its oblique open position and at its close position, respectively. The housing 60 in this embodiment is a built-in type housing, which is directly installed inside the neck 26.

As shown in FIG. 3A, the valve member 50 is oblique open to a maximum inclination angle θ. To prevent the valve member 50 from overturning in the second passage 604 and from hitting a structural dead point, the maximum inclination angle θ should not be more than 90 degree .

In order to regulate the movement of the valve member 50, the valve member 50 can further include a shoulder structure located on the top side 501 of the plate 51 and located oppositely to the pivot means (i.e. the pivot shaft 53 in FIG. 2) with respect to the center line 504 of the plate 51. The shoulder structure can further include top extension for providing a block means with respect to the top rim 602 of the housing 60. According to the present invention, while the scroll machine is in stop operation or in compression operations, the top extension can rest upon the top rim 602 of the housing 60 as a stop element for maintaining the valve member 50 at the close and the oblique open positions inside the second passage 604, respectively. On the other hand, while the valve member 50 is located at any position between the close and the oblique open positions, the shoulder structure is free to rotate inside the second passage 604.

As shown in FIG. 2, the shoulder structure can be a pair of side wings 55 located oppositely on the plate 51. Each side wing 55 has a substantial width and a top out-bent portion 551 to interfere with the top rim 604 of the housing 60 in the case that the valve member 50 reaches the close or the oblique open position, as shown in FIG. 3B and FIG. 3A respectively.

Referring now to FIG. 3A, while the scroll machine is in compression operation, the forced flow of the working media will flow through the second passage 604 from the offset hole 23 of the non-orbiting scroll member 24. When the flow hits the valve member 50, an unbalance moment (counter clockwise in FIG. 3A) along the pivot shaft 53 will be generated to push the valve member 50 open to the angle θ. Such an unbalance moment is accounting for the unequal plate surfaces separated by the pivot shaft 53. The angle θ is then sustained during the compression operation, because the top out-bent portion 551 of the side wing 55 interferes with the top rim 602 of the housing 60.

Referring now to FIG. 3B. while the scroll machine stops, the reverse flow from the high-pressure room into the axle hole 22 of the neck 26 will be generated due to the pressure difference therebetween. Because the offset pivot shaft 53 of the valve member 50, a moment to close the valve member 50 (clockwise in FIG. 3B) will be rendered by the unequal plate surfaces separated by the pivot shaft 53. As shown in FIG. 3B, the valve member 50 can then hold a horizontal status to substantially block the second passage 604 because of the out-bent portion 551 of the side wing 55 resting on the top rim 602 of the housing 60.

In another embodiment of the shoulder structure, the shoulder structure can be embodied as a first node point and a second node point, both of them located at the wall of the second passage 604. The positions of the first node point and the second node point are arranged in such a manner that: in the case that the scroll machine is in stop operation or in compression operation, the valve member is halted at the close or the oblique open positions by the first and the second node points, respectively. Actually, the first node point and the second node point on the wall of the second passage 604 work as the restriction bumps for confining the valve member 50 to rotate therebetween.

As shown in FIG. 3A and FIG. 3B, the coupling of the housing 60 and the neck 26 is a built-in type, in which the check valve is completely mounted in the axle hole 22. However, any type of the housing 60 that can form a through passage for the housing 60 and the neck 26 is also a prospective housing 60 structure.

Figure 4:
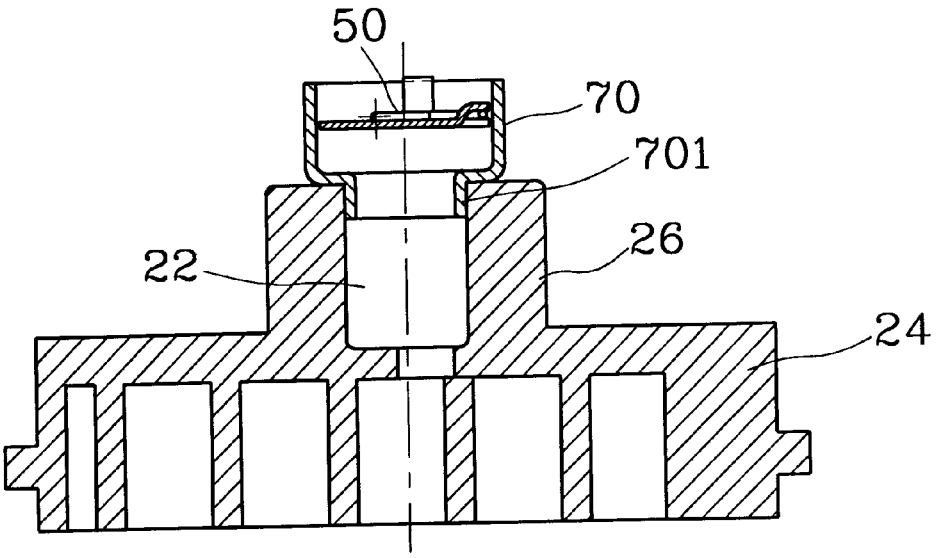
FIG. 4 is a cross sectional view of the second embodiment of the check valve according to the present invention in the scroll machine.

Referring now to FIG. 4, a plug-in type of housing 70 is shown to have a shrinkage bottom end 701 for plugging into the axle hole 22 of the neck 26.

Figure 5:
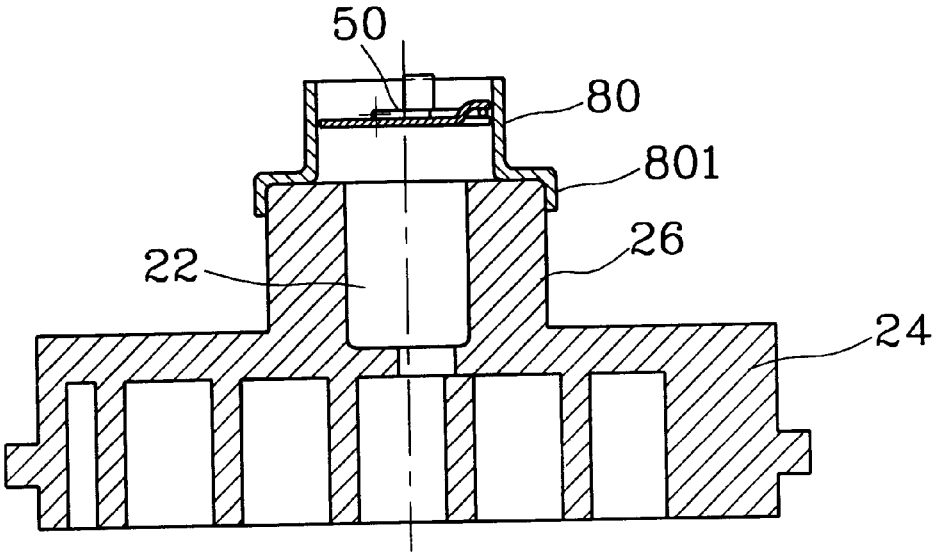
FIG. 5 is a cross sectional view of the third embodiment of the check valve according to the present invention in the scroll machine.

Referring now to FIG. 5, an envelope type of housing 80 is shown to have an extended bottom end 801 for providing a larger open end to sit on the top end of the housing 80.

In another embodiment of the present invention, the check device can also be utilized in pressure piping for regulating the in-pipe flow at a unique direction. In this embodiment, the check valve is installed in a pressure pipe, or at the terminal of a pressure pipe. All the components' positions and configurations in the embodiment are the same as those described in the aforesaid description.

While the present invention has been particularly shown and described with reference to preferred embodiments, it will be understood by those skilled in the art that various changes in form and detail may be without departing from the spirit and scope of the present invention.

What is claimed is:

1. A check valve device for a scroll machine, which is mounted on the neck of the non-orbiting scroll member of the scroll machine and in which the neck further has an axle hole defining a first passage for flowing the working media, comprising:

a housing, having a top open end with a top rim, a bottom open end, and a second passage formed through the top and the bottom open ends, the housing mounted on the neck via the bottom open end, and thereby a through passage formed for connecting the first passage of the neck and the second passage of the housing;

and a valve member, located inside the second passage of the housing and formed as a plate having a top side and a bottom side, the valve member having a pivot means located on the plate but offset with the center line of the plate to engage with wall of the second passage so that the plate can rotate along with; while the scroll machine in stop operation, the valve member at a close position inside the second passage so that the valve member substantially blocks the flow of the working media inside the second passage; and while the scroll machine in compression operation, the valve member at an oblique open position with a maximum inclination angle inside the second passage for allowing the working media flowing through the through passage;

further wherein said pivot shaft is a symmetric curve member with a winding central portion for distributing weight of the pivot shaft upon the top side of the valve member.

2. The check valve device for a scroll machine of claim 1, wherein said housing is a built-in type housing located whole in the axle hole.

3. The check valve device for a scroll machine of claim 1, wherein said housing is a plug-in type housing with the bottom open end located in the axle hole.

4. The check valve device for a scroll machine of claim 1, wherein said housing is an envelope type housing with the bottom open end wrapped onto the neck.

5. The check valve device for a scroll machine of claim 1, wherein said pivot means is a pivot shaft mounted on the top side of the plate, and the pivot shaft has two ends thereof protruding over edge of the plate to pivotally engage with the wall of the second passage.

6. The check valve device for a scroll machine of claim 1, wherein said maximum inclination angle is less than 90 degrees.

7. The check valve device for a scroll machine of claim 1, wherein said housing further includes a first node point and a second node point located at the wall of the second passage; while the scroll machine in stop operation and in compression operation, the valve member halted at the close and the oblique open positions by the first and the second node points, respectively.

8. A check valve device for a scroll machine, which is mounted on the neck of the non-orbiting scroll member of the scroll machine and in which the neck further has an axle hole defining a first passage for flowing the working media, comprising:

a housing, having a top open end with a top rim, a bottom open end, and a second passage formed through the top and the bottom open ends, the housing mounted on the neck via the bottom open end, and thereby a through passage formed for connecting the first passage of the neck and the second passage of the housing;

and a valve member, located inside the second passage of the housing and formed as a plate having a top side and a bottom side, the valve member having a pivot means located on the plate but offset with the center line of the plate to engage with wall of the second passage so that the plate can rotate along with; while the scroll machine in stop operation, the valve member at a close position inside the second passage so that the valve member substantially blocks the flow of the working media inside the second passage; and while the scroll machine in compression operation, the valve member at an oblique open position with a maximum inclination angle inside the second passage for allowing the working media flowing through the through passage;

wherein said valve member further includes a shoulder structure located on the top side of the plate and located oppositely to the pivot means with respect to the center line of the plate, the shoulder structure further having top extension, such that when the scroll machine in stop operation and in compression operation, the top extension resting upon the top rim of the housing as a stop element for maintaining the valve member at the close and the oblique open positions inside the second passage, respectively, and when the valve member located at a position between the close and the oblique open positions, the shoulder structure free to rotate inside the second passage;

further wherein said shoulder structure includes a pair of side wings located oppositely on valve member, each side wing having a substantial width and having a top out-bent portion to interfere with the top rim of the housing while the valve member at the close position and at the oblique open position.

9. A check valve device for pressure piping, which is mounted on the open terminal of a pressure pipe defining an internal first passage for flowing the working media, comprising:

a housing, having a top open end with a top rim, a bottom open end, and a second passage formed through the top and the bottom open ends, the housing mounted on the terminal via the bottom open end, and thereby a through passage formed for connecting the first passage of the terminal and the second passage of the housing;

and a valve member, located inside the second passage of the housing and formed as a plate having a top side and a bottom side, the valve member having a pivot means located on the plate but offset with the center line of the plate to engage with wall of the second passage so that the plate can rotate along with;

wherein when the pressure inside the pressure pipe less than the pressure outside the pressure pipe, the valve member at a close position inside the second passage so that the valve member substantially blocks the flow of the working media inside the second passage;

and when the pressure inside the pressure pipe higher than the pressure outside the pressure pipe, the valve member at an oblique open position with a maximum inclination angle inside the second passage for allowing the working media flowing through the through passage;

wherein said pivot shaft is a symmetric curve member with a winding central portion for distributing weight of the pivot shaft upon the top side of the valve member.

10. The check valve device for pressure piping of claim 9, wherein said housing is a built-in type housing located whole inside the pressure pipe.

11. The check valve device for pressure piping of claim 9, wherein said housing is a plug-in type housing with the bottom open end located in the terminal.

12. The check valve device for pressure piping of claim 9, wherein said housing is an envelope type housing with the bottom open end wrapped onto the terminal.

13. The check valve device for pressure piping of claim 9, wherein said pivot means is a pivot shaft mounted on the top side of the plate, and the pivot shaft has two ends thereof protruding over edge of the plate to pivotally engage with the wall of the second passage.

14. The check valve device for pressure piping of claim 9, wherein said maximum inclination angle is less than 90 degrees.

15. A check valve device for pressure piping, which is mounted on the open terminal of a pressure pipe defining an internal first passage for flowing the working media, comprising:

a housing, having a top open end with a top rim, a bottom open end, and a second passage formed through the top and the bottom open ends, the housing mounted on the terminal via the bottom open end, and thereby a through passage formed for connecting the first passage of the terminal and the second passage of the housing; and a valve member, located inside the second passage of the housing and formed as a plate having a top side and a bottom side, the valve member having a pivot means located on the plate but offset with the center line of the plate to engage with wall of the second passage so that the plate can rotate along with;

wherein when the pressure inside the pressure pipe less than the pressure outside the pressure pipe, the valve member at a close position inside the second passage so that the valve member substantially blocks the flow of the working media inside the second passage;

and when the pressure inside the pressure pipe higher than the pressure outside the pressure pipe, the valve member at an oblique open position with a maximum inclination angle inside the second passage for allowing the working media flowing through the through passage;

further wherein said valve member further includes a shoulder structure located on the top side of the plate and located oppositely to the pivot means with respect to the center line of the plate, the shoulder structure further having top extension, such that when the pressure inside the pressure pipe less than the pressure outside the pressure pipe, the top extension resting upon the top rim of the housing as a stop element at one aspect for maintaining the valve member at the close position, when the pressure inside the pressure pipe higher than the pressure outside the pressure pipe, the top extension resting upon the top rim of the housing as a stop element at another aspect for maintaining the valve member at the oblique open position inside the second passage, and when the valve member located at a position between the close and the oblique open positions, the shoulder structure free to rotate inside the second passage; and said shoulder structure includes a pair of side wings located oppositely on valve member, each side wing having a substantial width and having a top out-bent portion to interfere with the top rim of the housing while the valve member at the close position and at the oblique open position.

16. The check valve device for pressure piping of claim 9, wherein said housing further includes a first node point and a second node point located at the wall of the second passage; while the pressure inside the pressure pipe less than the pressure outside the pressure pipe, the valve member halted at the close position by the first node point; and while the pressure inside the pressure pipe higher than the pressure outside the pressure, the valve member halted to the oblique open position by the second node point.

* * * * *